United States Patent [19]

Holcomb et al.

[11] Patent Number: 4,753,277

[45] Date of Patent: Jun. 28, 1988

[54] BEVERAGE DISPENSER FOR FILLING CUPS WITH AUTOMATIC LEVEL RESPONSIVE SHUT-OFF OF DISPENSING

[75] Inventors: Donald E. Holcomb, Brooklyn Center; Henry C. Kovar, Brooklyn Park, both of Minn.

[73] Assignee: The Cornelius Company, Anoka, Minn.

[21] Appl. No.: 824,819

[22] Filed: Jan. 31, 1986

[51] Int. Cl.[4] ..... B65B 3/04; B65B 3/26

[52] U.S. Cl. ..... 141/95; 137/390; 137/392; 137/2; 222/148; 222/1; 222/64; 141/198; 141/1; 141/83; 141/361; 141/367; 141/82; 141/89

[58] Field of Search ..... 141/83, 94, 95, 192, 141/198, 1, 11, 69, 82, 85, 89, 351, 360, 361, 367; 137/392, 386, 390, 404, 341, 12, 5, 2; 222/1, 148, 64, 56, 52

[56] References Cited

U.S. PATENT DOCUMENTS

| | | | |
|---|---|---|---|
| 2,639,078 | 5/1953 | Karler | 137/386 X |
| 2,919,726 | 1/1960 | Zimmermann et al. | 141/361 X |
| 3,269,606 | 8/1966 | Armstrong | 141/360 X |
| 3,520,638 | 7/1970 | McUmber et al. | 137/392 X |
| 3,616,824 | 11/1971 | Orlando | 141/198 |
| 3,670,765 | 6/1972 | Aaynes | 137/392 |
| 3,839,645 | 10/1974 | Nickerson | 137/392 X |
| 3,916,963 | 11/1975 | McIntosh | 141/198 |
| 4,236,553 | 12/1980 | Reichenberger | 141/198 |
| 4,590,974 | 5/1986 | Mathews | 141/1 |
| 4,641,692 | 2/1987 | Bennett | 141/95 |
| 4,712,591 | 12/1987 | McCann et al. | 141/95 X |

*Primary Examiner*—Henry J. Recla
*Assistant Examiner*—Ernest G. Cusick
*Attorney, Agent, or Firm*—Henry C. Kovar

[57] ABSTRACT

A beverage dispenser has a housing, a dispenser head with an electrically conductive combination cup actuator lever and beverage level probe, a control circuit connected to the probe and to a start switch actuatable by the probe and to a solenoid for a beverage valve, and a drip tray and cup rest wherein the cup rest is tilted rearward toward the actuator lever to hold a cup against the lever and keep the back of the cup rim against the lever. An improved actuator lever has a dielectric journal, an electrically conductive thin wall metal tube cantilevered probe extending down from a single fastener securing a control lead and the probe to the journal piece and the conductive probe is spaced from and is below the level of the valve body and lever fulcrum. A conductive plastic flow control is mounted in the valve body and a second control lead is connected to the electrically conductive flow control for providing a potential signal in the beverage. A heater element for the probe either continuously or intermittently heats the probe to keep it insect free and sanitary.

31 Claims, 3 Drawing Sheets

36
34
44
62
42
45
24
46
58
14
72
52
26
70
48
32
74

34
44
45
56
54
52
62
46
60
68
66
64
78
58
48
75
74
75
70
50

BEVERAGE DISPENSER FOR FILLING CUPS WITH AUTOMATIC LEVEL RESPONSIVE SHUT-OFF OF DISPENSING

BACKGROUND OF THE INVENTION

1. Field of the Invention

This invention pertains to a beverage dispensing head having an electrically conductive actuator lever that when pushed by a cup starts dispensing and which when contacted by beverage in the cup passes an electrical signal to a dispensing control circuit that automatically terminates dispensing, and also to a new conductive lever for a beverage dispensing head, and to a new beverage dispenser.

2. The Prior Art

The most relevant known prior art is L. D. McIntosh U.S. Pat. No. 3,916,963 of Nov. 4, 1975, which is owned by The Cornelius Company, assignee of the present invention, McIntosh is the original and first inventor of an automatic beverage dispensing system in which dispensing is started by the placement of a cup under a nozzle and against and into a movable conductive actuator lever, and then automatically terminated when the beverage in the cup reaches and touches the lever. The beverage reaching and touching the lever is electrically sensed via a small electrical potential sent into the cup and and then to the lever via the beverage in the cup. McIntosh will properly fill a cup regardless of how much ice is in it, regardless of the diameter of the cup and regardless of variations in the height of the cup.

A. M. Reichenberger U.S. Pat. No. 4,236,553 has application of a voltage potential upon the beverage in the dispensing head, and a conductive cup lever which will accommodate a range of different height cups.

J. E. Haynes U.S. Pat. No. 3,670,765 has two probes which are inserted into the cup to control a single filling level and give automatic shut-off at this single level.

H. R. Karlen U.S. Pat. No. 2,639,078 has a coffee machine in which the coffee pot carries a single level probe connectible to an electronic shut-off control.

D. Nickerson U.S. Pat. No. 3,839,645 has a two-level electronic fill control using either a short or tall probe inside of a beverage cup.

All of the foregoing have suffered from excessive complexity and the disclosed embodiments have not enjoyed commercial success, save for Karlen. Sanitation of the actuation lever has been a problem, as McIntosh, Reichenberger and the others all require the beverage to contact a conductive lever member, and insects and the like can land on these members and feed on the residual beverage left on the conductive lever. Some of the previous levers have been difficult to clean and keep sanitary. Sanitation is becoming more and more important with the re-emergence of draft beer and with the relatively new soft drinks containing high percentages of natural juices. Sanitation is now becoming acutely important with the emergence of viral disease transmission. The prior art is not sufficiently sanitary to work with 100 percent juice, high percentage juice soft drinks, or beer. Electrical shunting and feed back are also a problem because of cross-feed from adjacent valves, and because the prior art device must be washed and cleaned very carefully and then completely dried to prevent electrical malfunctions.

Push back of almost empty cups has also been a problem. The prior devices tend to push back an empty cup and then stop dispensing with an almost empty cup. The weight of an empty cup has not been enough to hold the actuator lever back, without the cup being manually held.

The concept of McIntosh in 1975 was very promising and was very well received, but further invention is needed to attain commercial success.

OBJECTS OF THE INVENTION

It is an object of the present invention to provide a beverage dispensing head having an improved electrically conductive actuator lever for starting and stopping dispensing.

It is an object of the present invention to provide a new and improved actuator lever having a conductive probe, for a beverage dispensing valve.

It is an object of the present invention to provide a beverage dispensing valve actuator lever having a new and improved sanitary and highly reliable construction.

It is an object of the present invention to provide a sanitary beverage dispensing valve actuator having an electrically conductive and heated beverage level probe.

It is an object of the present invention to provide a semi-automatic beverage dispensing head with a sanitary conductive plastic actuator lever of reliable and simplified construction.

It is an object of the present invention to provide an improved beverage dispensing valve having an improved structure for applying an electrical potential upon the beverage.

It is an object of the present invention to provide an improved beverage dispenser having improved cup rest structure for holding a cup against an actuator lever.

It is an object of the present invention to provide a sanitary method of dispensing beverage with automatic termination of the dispensing at a precise level in a cup.

These and other objects of the invention will become manifest to those versed in the art upon review of or use of the teachings herein.

SUMMARY OF THE INVENTION

According to the principles of the present invention, a beverage dispenser head having a nozzle, cup support, solenoid controlled valve, and electrical control circuit for the solenoid, has the improvement of a fulcrum in the valve body, an actuator lever extending down from the fulcrum with a dielectric journal mounted to the fulcrum and a conductive probe extending down from the journal, and an electrical lead connected to the probe at a level below the fulcrum.

A combination beverage level probe and dispensing actuator lever for a beverage dispensing head has a dielectric journal piece, an elongate electrically conductive probe secured to the journal piece, and structure for connection of an electrical lead to the probe.

A combination beverage level probe and dispensing actuator lever has an elongate electrically conductive metal tube having a closed upper and lower ends and structure for connection of an electrical lead, and suspension structure for rotatably hanging the tube from a dispensing head.

A beverage head combination beverage level probe and actuator lever has pivotal suspension structure, a hollow electrically conductive beverage level probe, having a leading edge for engaging a cup rim, an electric resistance heater element inside of the probe, a switch actuator, a first electrical lead from the probe, and a second electrical lead extending out of the probe from the heater.

A beverage dispenser combination beverage level probe and actuator lever has pivotal suspension structure, an elongate electrically and thermally conductive hollow metal tubular probe, a heater element in the tubular probe, a first lead from the probe, and a second lead out of the probe from the heater.

A beverage dispenser head with a nozzle, cup support, solenoid controlled valve, and electrical control circuit has an improved combination actuation lever and beverage level probe of electrically conductive plastic and a lead from the plastic lever to the control.

A beverage dispensing head having a valve body, nozzle, cup support, combination beverage level probe and actuator, and electrical control circuit has the improvement of an electrically conductive plug in the valve body and extending into a beverage passageway, and a source of electric potential connected to the plug.

An automatic shut-off beverage dispenser has a housing, a dispensing head mounted on the housing with the head having a combination beverage level probe and actuator lever, and a drip tray and cup rest having an improved structure for holding the cup against the lever.

A sanitary method of dispensing beverage into a cup and automatically shutting off beverage flow when the cup is filled has the steps of pushing back an actuator lever with a cup, terminating dispensing when the beverage in the cup reaches and makes contact with the lever by sending an electrical signal through the beverage and the lever to a control, withdrawing the cup from the lever, and heating the lever to keep it sanitary.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

AS SHOWN ON THE DRAWINGS

Figure 1:
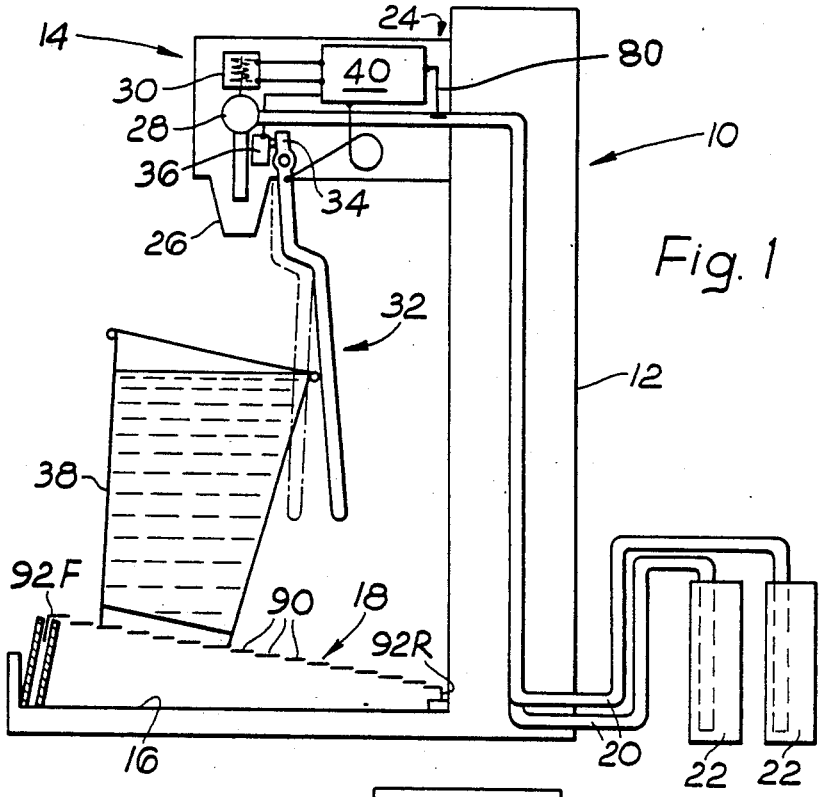
FIG. 1 is an elevational side view of the beverage dispenser of the present invention.

The principles of the present invention are particularly useful when embodied in a beverage dispenser such as shown in FIG. 1 and generally indicated by the numeral 10. The dispenser 10 has a housing 12, at least one and preferably more beverage dispensing heads each of which is generally indicated by the numeral 14, a drip tray 16, cup a rest 18 and a beverage supply line 20 which is for connection to a source of beverage 22. The dispensing head 14, which will individually hereinafter simply be referred to as the head 14, is often commonly referred to as a dispensing valve. The most common forms of dispensers 10 have four, five or six discrete heads 14, but some dispensers 10 are seen with only one head 14, particularly when used for beer. A specific example of a head 4 such as used herein is the subject of Forrest Austin U.S. Pat. No. 4,549,675 entitled "Beverage Dispensing Valve". The head 14, if for a past-mix soft drink will have discrete water and syrup supply lines, even though only a single line is shown as though the head 14 were for beer or pre-mix soft drink. In a post-mix head 14, the water and syrup are dispensed concurrently, some heads 14 having one operating solenoid and some having two operating solenoids connected in parallel to work concurrently.

The head 14 has a valve body generally indicated by the numeral 24, a nozzle 26, at least one and most frequently two normally closed (NC) valves 28 which is or are connected to and are openable by a solenoid 30. The head 14 has a combination beverage lever probe and actuator lever generally indicated by the numeral 32 which is an important feature of the present invention and which will hereafter simply be referred to as the lever 32. The lever 32 has a dielectric switch actuator 34 which engages and closes a normally open (NO) switch 36 when the lever 32 is pushed rearward by a cup 38. The switch 36 causes the solenoid 30 to become energized to open the valve 28 and start dispensing of beverage into the cup 38. A low voltage potential is applied by an electronic control 40 through a second lead 80 to the beverage in the supply line 20 and when beverage in the cup 38 reaches and makes contact with the lever 32, an electrical signal is sent through the beverage and the lever 32 by the control circuit 40 which automatically terminates dispensing. This basic device is the subject of and is disclosed in U.S. Pat. No. 3,916,963; incorporated hereinto by this reference thereto.

The lever 32 as shown in FIGS. 2–5 is suspended from a lever fulcrum 42 in the valve body 24 and at a level above the level of the nozzle 26. A dielectric plastic journal piece generally indicated by the numeral 44 has a dielectric hub 45 pivotally suspended on the fulcrum 42 and forms the upper portion of the lever 32. A dielectric front surface 46 of the journal piece 44 abuts against a dielectric backside of the nozzle 26 which gives a positive stop and location of the lever 32 with respect to the nozzle 26, as well as providing electrical isolation. The downward extending part of the lever 32 is a hollow stainless steel metal tube 48 mounted to the journal piece 44. The tube 48 is an elongate length of lightweight hollow tube having its bottom 50 spun and welded shut, and its top end flattened and closed into a mounting flange 52. The flange 52 has a slotted keyway 54 which is precisely fitted to a key 56 on the journal piece 44. A mounting screw 58 is driven through a terminal 60 of a control lead 62, and through an aperture 64 in the flange 52, and into a threaded bore 66 in the lower leg 68 of the journal piece 44 to selectively connect the lead 62 to the tube 48 and to fasten the lead 62, and tube 48 to the backside of the journal piece 44. After the screw 58 is driven in and tightened, a dielectric sheath 70 is slipped up and over the lower leg 68, the flange 52, terminal 60 and screw 58 and is shrunk onto the lever 32, flange 52, terminal 60 and screw 58 to positively lock and hold the assembly together and to electrically insulate the top of the tube 48. The lever 32 extends downward out of the valve body 24 through a drain port 72 in a floor of the head 14. The sheath 70 extends through the drain port 72 so that the electrically conductive tube 48 is not exposed in the valve body 24. The lower leg 68 and switch actuator 34 are on opposite sides of the journal piece 44 and are spaced from each other so that the tube 48 is entirely below the fulcrum 42, the switch actuator 34 and the switch 36 so that the electrically conductive tube 48 is electrically isolated from the fulcrum 42. The sheath 70 extends downward to at least the mid level of the nozzle 26 and protects the electric connection from splashing syrup and water. The lead terminal 60 is fastened to the lever 32 below the fulcrum 42 and the lead 62 runs up past the fulcrum 42. This construction minimizes flexing of the lead 62 and extends the life expectancy. The tube 48 is spaced rearward of the fulcrum 42 and has a rearward directed offset 74 which is to the rear of and below the nozzle 26 and which tends to keep a cup 38 spaced below the nozzle 26 so that beverage is not forced up onto the nozzle 26 and into the valve body 24 by a prankster. The tube 48 is very light and exerts minimum forward torque against the cup 38. This significantly helps to prevent the cup 38 from being pushed forward by the lever 32 and having the dispenser 10 prematurely shut off. The downward extending end of the tube 48 has a slightly flattened section which provides a flat leading surface 75 for engagement with the cup 38.

Figure 5:
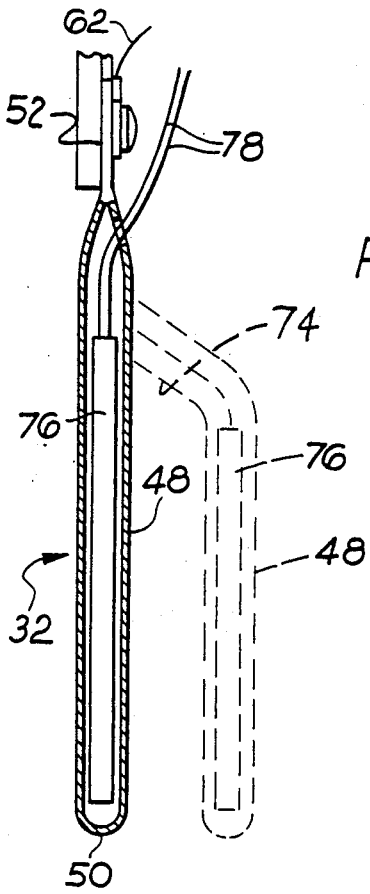
FIG. 5 is the structure of FIG. 3 with an optional heater for sanitation.

In the lever of FIG. 5, an electrical resistance heater element 76 is inside of the tube 48, and a pair of leads 78 from the heater 76 extended through and out of the tube 48 through an aperture below the flange 52. The heater 76 will heat the tube 48 to a temperature sufficiently high to keep insects off and to keep the tube 48 dry, sanitary, and free of contaminants. The heater 76 is spaced well below the valve body 24 so that little, if any, heat gets back to the beverage for prevention of warm-up and foaming of the beverage. This may enable refilling of glasses, beer mugs and glasses, mugs or pitchers whereas otherwise new pitchers would be required.

Figure 6:
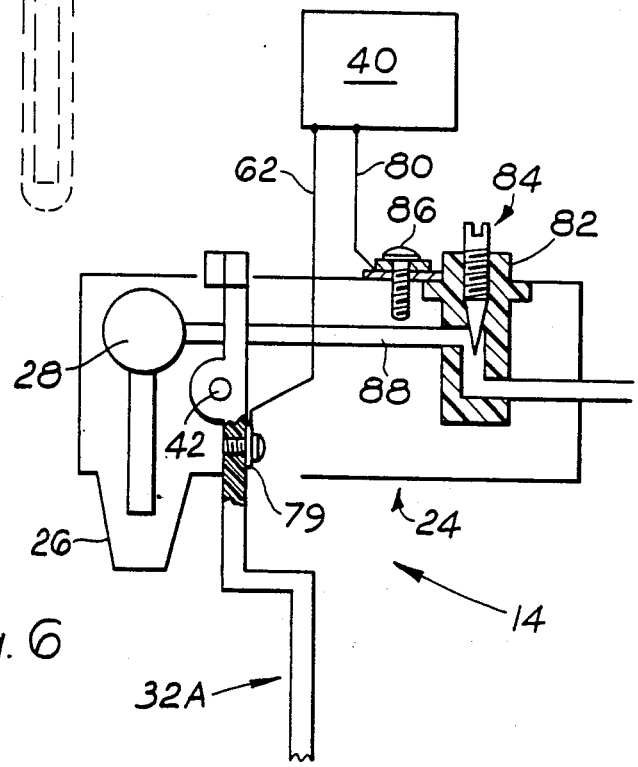
FIG. 6 is an elevational side view similar to FIG. 3, but with electrically conductive plastic componentry in the beverage dispensing valve.

In FIG. 6, a preferred structure for applying an electric potential to the beverage is shown. A second lead 80 from the control circuit 40 is connected to a conductive plastic housing 82 of an adjustable beverage volumetric flow rate control valve generally indicated by the numeral. The lead 80 is conductively fastened to and connected to the conductive plastic housing 82 by a screw 86 driven into the valve body 24, the screw 86 holds the conductive plastic housing 82 in the valve body 24 to plug an opening leading into the beverage passageway 88. An alternative low cost, lightweight contiguous single piece plastic combination beverage probe and actuator lever 32A is also shown. The alternative plastic lever 32A and plastic flow control housing 82 are both molded of an electrically conductive FDA approved thermo-plastic such as carbon fiber-filled polycarbonate or nylon.

The alternative plastic lever 32A has a very light downward extending cup engaging portion 75A that is offset to the rear of the fulcrum 42. Again the forward moment of the lever 32A is minimized so that an empty cup 38 is not pushed back by the lever 32A. While this alternative lever 32A may not provide the exceptionally high degree of electrical isolation that is provided by the preferred lever 32, the alternative lever 32A is lower cost and may be commercially preferrable even though it may not be cleaned with a water spray and left wet as can the preferred lever 32. The plastic lever 32A may be cored out and may also have a heater 76 in it. The lead 62 is connected to the lever 32A by the screw 58 being tightened into an electrically conductive metal insert 79 embedded in the plastic lever 32A. The top of the alternative lever 32A may be dipped in a varnish or similar material to provide a dielectric exterior and electrical insulation from the fulcrum 42 and valve body 24 and nozzle 26.

The cup rest 18 as shown in FIG. 1 is tilted rearward towards the lever 32 to hold the cup 38 in a position biased against the lever 32. The rest 18 has transverse grate members 90 that have rear edges that face against the cup 38 bottom and tend to hold the cup 38 against the lever 32, and hold the cup 38 against the push back of the lever 32 so that the lever 32 does not push an almost empty cup 38 back and shut off the dispenser 10. The outer surfaces of the cup rest 18 are preferably dielectric to prevent cross circuitry from one dispensing head 14 to another when two or more adjacent heads 14 are concurrently dispensing. The cup rest 18 may be nylon coated steel as an example. The cup rest 18 has front and rear legs 92F, 92R. Tubular dielectric plastic spacers are secured to the front legs 92F to hold up the front of the cup rest 18 and tilt it toward the lever 32. The tilt, the grates 90 and the lightweight lever 32 all contribute to enable an almost empty cup to hold the lever 32 back.

Figure 2:
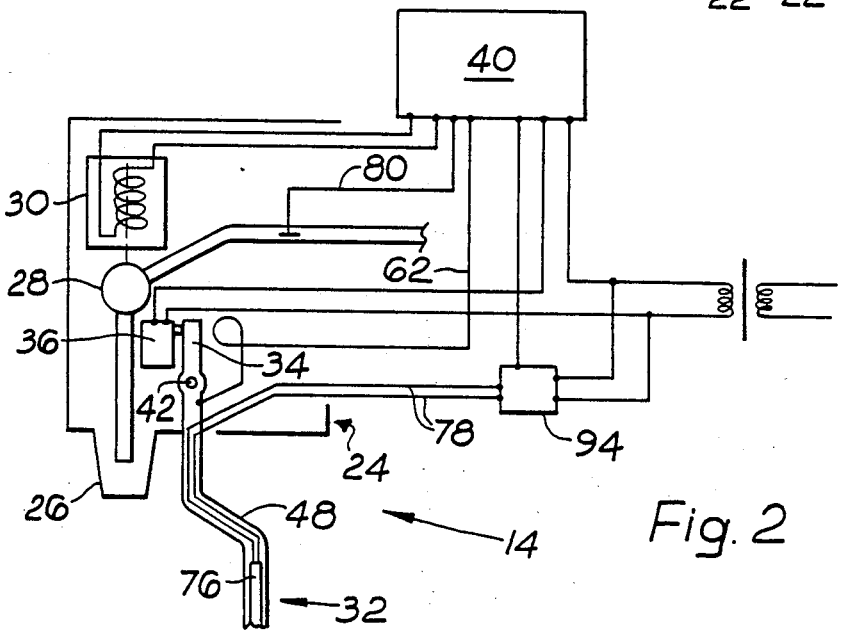
FIG. 2 is a schematic of the electrical circuitry of the structure of FIG. 1.
Figures 3, 4:
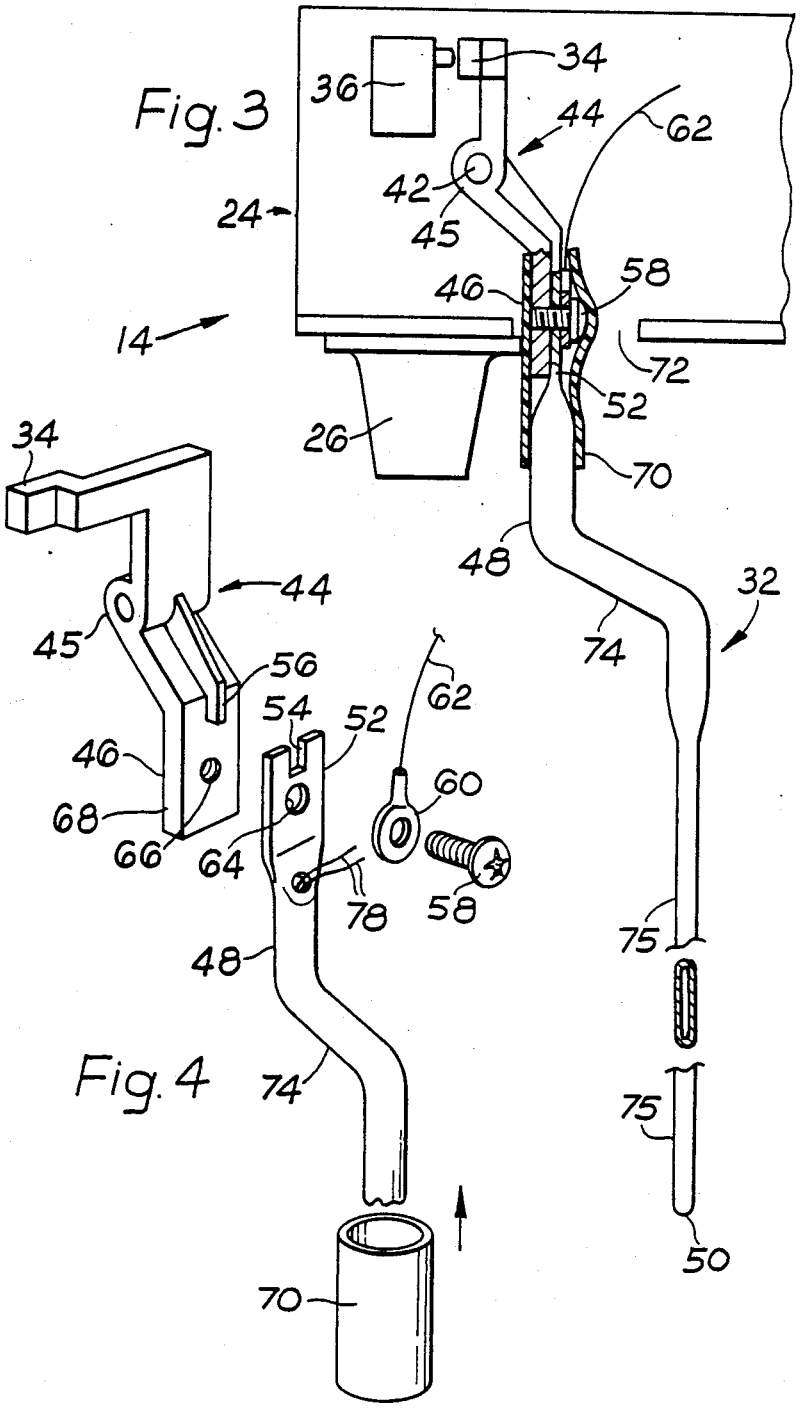
FIG. 3 is an elevational side view detail of the combination beverage probe and actuator lever of the dispenser of FIG. 1.
FIG. 4 is a broken apart view of the structure of FIG. 3.

The circuitry is shown in FIG. 2 wherein the control circuit 40 contains the control logic. A complete circuit is disclosed and explained in U.S. Pat. No. 3,916,963. Briefly , line voltage of about 24 VAC is to be fed to a normally unenergized control 40 through the NO actuator switch 36. The switch 36 closes in response to pivotal movement of the lever 32 and the control 40 becomes energized and effects energization of the solenoid 30 and opening of the NC beverage valves 28 whereupon beverage flows into the cup 38. When the beverage in the cup 38 reaches the cup rim and contacts the lever 32, an electrical signal is sent from the second lead 80 through the conductive flow control housing 82, the beverage in the passageway 88 and nozzle 26, and the beverage in the cup 38 and the flowing stream beverage from the nozzle 26 to the cup 12, to the lever 32 and then up the first lead 62 to the control 40. When the control 40 receives the signal, the control 40 de-energizes the solenoid 30 and dispensing is automatically terminated. A time delay can be provided to take into account premature shut-off due to foam or bubbles on top of the real beverage level. Such a delay device is shown in Reichenberger U.S. Pat. No. 4,236,553. The heater 76 can be hooked directly to the supply power and can be continuously energized, or it can be under the control of a control gate 94 that may be a latchable timer, driven by the control 40. At each occurrence of dispensing, the heater 76 can be turned on for an appropriate time, and then turned off. If the dispenser 10 has not been used for some time, say an hour, the control 40 may turn off the heater 76 and it may stay turned off overnight until the first dispensing cycle in the morning. The exact criteria for operation of the heater 76 will depend to a great degree upon the environment, the local sanitation agencies, and the operator of the dispenser 10.

Although other advantages may be found and realized and various modifications may be suggested to those versed in the art, it should be understood that we wish to embody within the scope of the patent warranted hereon, all such embodiments as reasonably and properly come within the scope of our contribution to the art.

We claim as our invention:

1. In a cold beverage dispenser head having a body with a nozzle for discharging beverage, a beverage cup support positioned and spaced below said nozzle fo receiving thereon a beverage cup with a circumferential upper rim, a normally closed solenoid controlled valve in a beverage line extending through said body to said nozzle for controlling discharge of beverage from said nozzle, a movable dispensing actuating lever having an electrically conductive beverage probe engageable with the cup rim firstly for starting dispensing and secondly for making electrical contact with cold beverage dispensed into said cup, and a control circuit electrically interconnecting said lever and probe for actuating said solenoid controlled valve to start dispensing upon movement of the lever and probe by the cup and for terminating actuation of said solenoid controlled valve to stop the dispensing of beverage into the cup when the dispensed beverage attains a predetermined level in the beverage cup and makes contact with the probe or when the cup is withdrawn from the lever and probe;

the improvement comprising:

(a) a lever and probe fulcrum fixed in and with respect to said body, said fulcrum being at a level above the level of said nozzle;

(b) said probe being an elongate electrically conductive structure fixed to said lever and extending downward below the fulcrum from a level adjacent to a bottom of the nozzle to a lower level spaced well below the nozzle, said probe being directly engageable against the cup rim during dispensing;

(c) discrete dielectric means pivotally mounting said lever and probe directly upon said fulcrum and to said body, said dielectric means electrically isolating the probe from both the fulcrum and the body;

(d) a discrete first lead electrically connecting said probe to said control circuit during dispensing and providing electrical continuity between saiad dispensed beverage at the cup rim and the control circuit during dispensing thereby enabling a beverage sensing signal to be sent from the control circuit in a loop through the dispensed beverage and across the cup rim and through the probe to the control circuit, for reliably and repeatedly automatically terminating dispensing as soon as the dispensed beverage fills the cup to the rim and contacts the probe; and (e) a discrete second lead electrically extending through said body and into said beverage line, said second lead being connected to and under the control of said control circuit for effecting the beverage sensing signal into the dispensed beverage in the cup during dispensing, said dielectric means preventing signal feed between the probe and either of the fulcrum or body.

2. The improved beverage dispenser head of claim 1, in which the lever has a dielectric forward facing outer surface which abuts against a rear surface of the nozzle, forming a forward limit stop for the lever, the connection of the first lead being on a backside of the probe.

3. The improved beverage dispenser head of claim 1, in which said probe is a hollow metal tube spaced rearward of the fulcrum.

4. The improved beverage dispensing head of claim 1, in which said probe is a lightweight hollow tube having (a) a flattened and closed upper end fastened to and against a dielectric journal piece having therein said direction means, and (b) a closed lower end.

5. The improved beverage dispensing head of claim 4, in which the probe tube flattened upper end has a key which is keyed to the journal piece, said upper end being mounted to the journal piece by a fastener which also connects said first lead from the control circuit to the probe tube.

6. The improved beverage dispensing head of claim 5, in which the tube upper end, fastener, and first lead at said fastener are all three enclosed by a dielectric sheath.

7. The improved beverage dispensing head of claim 6, in which the sheath extends downward at least to a mid level of the nozzle.

8. The improved beverage dispensing head of claim 1, including an actuation switch mounted to the body at a level above the level of the fulcrum, and a dielectric switch actuator above the probe and the dielectric means, said switch actuator being spaced above and from the probe, and further including a drain port in a floor of the head, the probe and the connection of said first lead thereto having dielectric outer sheathing covering the connection and extending through the drain port and to a level below the floor.

9. The improved beverage dispensing head of claim 1, including an electrically conductive beverage volumetric flow rate control valve mounted in the body and upstream of said solenoid controlled valve, said second electrical lead connecting the control circuit to the volumetric flow rate control, said second lead electrically connecting the control circuit to beverage in the beverage line via the electrical continuity of the volumetric flow rate control valve.

10. A sanitary method of dispensing beverage into a cup and automatically shutting off beverage flow when the cup is filled, comprising the steps of:

(a) pushing back an actuator lever with a cup and initiating beverage flow into the cup in response to movement of the lever;

(b) terminating dispensing of the beverage in response to the level of the beverage in the cup reaching and making contact with the lever by sending an electrical signal through the beverage and the lever to a dispensing control having means for terminating dispensing;

(c) withdrawing the filled cup from the lever; and (d) heating the lever to keep the lever sanitary and free of biological contaminant.

11. The method of claim 10, in which the step of heating the lever is done intermittently.

12. The method of claim 11, in which the intermittent steps of heating the lever are done in response to movement of the actuator lever.

13. The method of claim 10, in which the step of heating the lever is done continuously.

14. The method of claim 10, in which the cup is tilted into the heated lever, with the lowest part of the cup rim directly contacting the lever during filling of the cup.

15. The method of claim 10, including the further step of terminating the heating after a period of non-use, and then restarting the heating upon restart of dispensing.

16. An improved beverage dispensing head combination beverage level probe and dispensing actuator lever for control of both start and automatic stop of beverage dispensing into cups, comprising:

(a) an elongate electrically conductive hollow metal tube forming said probe and having
(1) a flattened and closed upper end,
(2) connection means on said upper end for connection of an electrically conductive lead thereto,
(3) a closed lower end,
(b) a journal piece for rotatably hanging the tube from a beverage dispensing head;
(c) an electrically conductive lead having a first end secured to the connection means, said connection means securing said tube to said journal piece, and including
(d) a dielectric sheath surounding the lead first end and connection means and the securement of the tube to the journal piece.

17. The beverage dispensing head lever of claim 16, in which the tube is spaced rearward of said journal piece.

18. The beverage dispensing head lever of claim 16, in which the journal piece is dielectric and is fastened to the tube, said journal piece having a discrete pivot journal being spaced from and above all of the conductive tube.

19. The beverage dispensing head lever of claim 16, in which a lower portion of the tube is offset from and spaced rearwardly of the journal piece, said tube lower portion being partially flattened and having a partially flat electrically conductive leading surface facing toward a front side of the lever.

20. A sanitary beverage dispenser head combination beverage lever probe and actuator lever for both mechanically starting and automatically stopping beverage dispensing into a cup, comprising:

(a) suspension means for pivotally hanging the lever in and from a beverage dispensing head;
(b) a hollow electrically conductive elongate beverage level probe mounted to and extending as a cantilever from said suspension means, said probe having a leading edge for engaging an upper rim of the beverage cup and for contacting dispensed beverage at the cup rim;
(c) an electric resistance heater element inside of the hollow probe and rearward of the leading edge for heating the probe to a sanitizing temperature;
(d) switch actuator means depending from the suspension means for operation of a dispensing switch when the probe is pushed by a cup and the lever is pivoted about said suspension means;
(e) a first electrical lead extending from the probe for electrical connection of the probe to a beverage shut-off control; and
(f) a second electrical lead extending out of the probe from the heater element for connection to a source of power for the element.

21. The beverage dispepnsing head lever of claim 20, in which the probe is hollow metal tubing having a closed bottom end.

22. In a cold beverage dispenser head including a valve body having a nozzle for discharging beverage, a beverage cup support positioned and spaced below said nozzle for receiving thereon a beverage cup having a circumferential top rim, a normally closed solenoid controlled valve for controlling discharge of beverage from said nozzle, a dispensing switch operatively connected to affect opening of said valve, a movable combination dispensing actuator lever and electrically conductive beverage level probe engageable with said top rim of a cup on said support for firstly starting dispensing and thereafter making electrical contact with beverage dispensed into said cup, and a control circuit electrically interconnecting said probe to said solenoid controlled valve for terminating actuation of said valve to stop the dispensing of beverage into the cup when the dispensed beverage attains a predetermined level in the beverage cup and makes contact with the probe;

the improvement comprising:

an electrically conductive thermoplastic beverage volumetric flow rate control mounted in the valve body, said volumetric flow rate control being fixed in said body spaced from and discretely of said solenoid controlled valve and being extended into a beverage pathway in the body; and an electrical connection of said control to said volumetric flow rate control, an electrical potential from the control being applicable to beverage in the cup via beverage flowing in the pathway through the volumetric flow rate control, through said solenoid controlled valve, through said nozzle, and in a stream from the nozzle into the cup.

23. The improvement of claim 22, in which an electrical lead from the control has an end electrically fastened and connected to the flow control by means for retaining the flow control in the valve body.

24. An improved beverage dispensing head combination beverage level probe and dispensing actuator lever for control of both start and automatic stop of beverage dispensing into cups, comprising:

(a) a journal piece having dielectric journal means for dielectric pivotal suspension of the lever and probe in a beverage dispensing head;
(b) an elongate and electrically conductive beverage level probe secured to and extending downward from said journal piece, said probe being spaced from and being entirely on a first side of said journal means;
(c) connection means on said probe and on said first side of said journal suspension means for connection of an automatic beverage sensing electrical dispensing shut-off control circuit thereto;
(d) an electrical lead having a first end secured to said probe at said connection means and a second end connectible to the control circuit; and
(e) a dielectric sheath over and surrounding the connector means and the first lead end.

25. A beverage dispenser head combination beverage level probe and actuator lever for both mechanically start and automatic shut-off of beverage dispensing into a cup, comprising (a) suspension means for pivotally hanging the lever in and from a beverage dispensing head;
(b) an elongate electrically and thermally conductive hollow metal tubular dispensed beverage level probe mounted to and extending as a cantilever from said suspension means and being engageable by the rim of the cup;
(c) an electric resistance heater element inside of the tubular probe for heating the probe to a sanitizing temperature;
(d) a first electrical lead connected to and extending from the probe for electrical connection of the probe to an automatic dispensing shut-off control
(e) a second and discrete electrical lead extending out of the probe from the heater element for connection of the heater to a source of power; and (f) means for actuating a dispensing start switch upon movement of the probe by the cup being pressed there against.

26. In a mechanical start and level responsive automatic shut-off, cold beverage dispenser head including a body having a nozzle for discharging cold beverage, a beverage cup support positioned and spaced below said nozzle for receiving thereon a beverage cup having a circumferential upper rim, a normally closed solenoid controlled valve in a beverage line through said body to said nozzle for controlling discharge of beverage from said nozzle, a movable dispensing switch actuator lever having a beverage level sensor probe engageable with the cup rim for firstly starting dispensing and secondly making electrical contact with beverage dispensed into said cup; and a control circuit electrically interconnecting said probe to said solenoid controlled valve during dispensing for terminating actuation of said valve to stop the dispensing of beverage into the cup when the dispensed beverage attains a predetermined level in the beverage cup and makes contact with the probe, the improvement comprising:

(a) an actuator lever fulcrum fixed in said valve body at a level above a level of the nozzle;

(b) said actuator lever being made of an electrically conductive plastic having a journal piece pivotally mounted in said valve body to said fulcrum;

(c) said probe being of said electrically conductive plastic and being a downwardly hanging integral and elongate cantilevered structure depending form the journal piece;

(d) electrical connection means adjacent to said fulcrum and in contact with the electrically conductive plastic of said lever for the connection of said probe to said control during dispensing;

(e) an electrical lead having a first end electrically connected to said electrically conductive plastic probe via said connection means during dispensing, a second end of said lead being connected to the control circuit; and (f) means dielectrically insulating said electrically conductive plastic lever and probe from said fulcrum and said body during dispensing for preventing premature shut-off.

27. An automatic shut-off beverage dispenser, comprising (a) a dispenser housing (b) a dispensing head mounted to the housing and being fluidly connectible to a source of beverage, said head having a valve body, a nozzle mounted to the body, at least one solenoid actuated normally closed valve for control of beverage flow, an electrically conductive actuator lever extending downward to a level below the nozzle, said lever being engageable and movable by the upper rim of a beverage cup, a start switch responsive to movement of the lever for energizing the solenoid and starting dispensing, an electrical control interconnected to a source of power, the start switch, the solenoid, and the conductive lever, and means in the control for de-energizing the solenoid for terminating dispensing when the level of beverage in a cup being filled from the nozzle reaches and makes contact with the conductive lever;

(c) a drip tray and cup rest on the housing and under and spaced below the nozzle and the lever, said rest having an upward facing cup support surface tilted rearward toward the lever for supporting a to-be-filled cup in an attitude tipped toward the lever so that when the cup is supported upon the rest a lowest edge of the cup rim is in contact with the conductive lever; and (d) a rearwardly tilted transverse grate member on the top of said cup rest, said grate member having upward facing means for engaging the base of a cup thereon and holding the cup back against a forwardly biased pushed-back electrically conductive lever during dispensing without the attention of an operating person.

28. A beverage dispensing head actuator lever having an integral beverage level probe for control of both start and automatic beverage level responsive stop of beverage dispensing into a cup, comprising:

(a) a conductive plastic lever with an integral elongate and electrically conductive plastic beverage level probe having an elongate electrically conductive plastic surface for being engaged by the rim of a beverage cup;

(b) a dielectric journal for dielectric pivotal support of the conductive plastic lever in a beverage dispensing head;

(c) a switch actuator for actuation of a dispensing switch when the lever is pivoted by a cup about the dielectric journal; and (d) means for electrically connecting the conductive plastic lever to an electrical control circuit during beverage dispensing, so that an electrical potential signal in dispensed beverage in the cup can be fed during dispensing and through the electrically conductive plastic lever in a loop to the control only upon the dispensed beverage in the cup making electrical contact with the electrically conductive plastic lever, without signal loss through the journal for prevention of premature dispensing shut-off.

29. In a cold beverage dispenser head including a body having a nozzle for discharging beverage, a beverage cup support positioned and spaced below said nozzle for receiving thereon a beverage cup with a circumferential upper rim, a normally closed solenoid controlled valve in a beverage line through the body to said nozzle for controlling discharge of beverage from said nozzle, a movable dispenser actuator lever having a beverage level probe engageable with the cup rim firstly for starting dispensing and secondly for making electrical contact with beverage dispensed into said cup, and an automatic dispensing shut-off control circuit electrically interconnecting said lever and probe to said solenoid controlled valve for actuating said solenoid controlled valve to start dispensing upon movement of the lever and probe by the cup and for terminating actuation of said solenoid controlled valve to stop the dispensing of beverage into the cup when the dispensed beverage attains a predetermined level in the beverage cup and makes electrical contact with the probe or when the cup is withdrawn from the lever and probe;

the improvement comprising:

(a) said actuator lever being of electrically conductive plastic with the probe being an integral portion of said electrically conductive plastic lever, and including (b) dielectric means pivotally mounting and suspending the plastic lever in the body of the dispensing head and electrically insulating the conductive plastic lever from the body and beverage line of the dispensing head, so that all electrical signals through the conductive plastic lever and probe are communicated to the control circuit only via the dispensed beverage in the cup.

30. A beverage dispensing head combination level probe and dispensing actuator lever for control of both start and automatic stop of beverage dispensing into cups, comprising:

(a) an elongate electrically conductive hollow metal tube forming said probe and having
(1) a closed upper end,
(2) connection means in said upper end for connection of an electrically conductive lead thereto, (b) means for pivotally hanging the tube from a beverage dispensing head;

(c) means for actuating a dispenser switch when the tube is pivoted about the hanging means; and (d) an electrical resistance heater element inside of the tube, with a discrete electrical lead extending out of the tube from the heater element, said lead being connectible to a source of power for the heater.

31. An automatic shut-off beverage dispenser for filling cups, comprising:

(a) a dispenser housing;

(b) a dispensing head mounted to the housing and being fluidly connectible to a source of beverage, said head having a valve body, a nozzle mounted to the body, at least one solenoid actuated normally closed valve for control of beverage flow, an electrically conductive actuator lever extending downward to a level below the nozzle, said lever being engageable and movable by an upper rim of a beverage cup, a start switch responsive to movement of the lever for energizing the solenoid and starting dispensing, an electrical control interconnected to a source of power, the start switch, the solenoid, and the conductive lever, and means in the control for de-energizing the solenoid for terminating dispensing when the level of beverage in a cup being filled from the nozzle reaches and makes contact with the conductive lever;

(c) a drip tray and cup rest on the housing and under and spaced below the nozzle and the lever, said rest having an upward facing cup support surface tilted rearward toward the lever for supporting a to-be-filled cup in an attitude tipped toward the lever so that when the cup is supported upon the rest a lowest edge of the cup rim is in contact with the conductive lever; and in which said (d) lever has an electric resistance heating element adjacent a bottom of the lever and below and spaced from the valve body.

* * * * *